US010975742B2

(12) United States Patent
Isoshima et al.

(10) Patent No.: US 10,975,742 B2
(45) Date of Patent: Apr. 13, 2021

(54) BLOW-BY GAS RETURN DEVICE

(71) Applicant: KUBOTA Corporation, Osaka (JP)

(72) Inventors: Hiroaki Isoshima, Sakai (JP); Kentaro Shiraishi, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 63 days.

(21) Appl. No.: 15/985,535

(22) Filed: May 21, 2018

(65) Prior Publication Data

US 2019/0003357 A1 Jan. 3, 2019

(30) Foreign Application Priority Data

Jun. 29, 2017 (JP) ..... JP2017-127346

(51) Int. Cl.

| | |
|---|---|
| ***F01M 13/04*** | (2006.01) |
| ***F01M 13/00*** | (2006.01) |
| ***F02M 35/10*** | (2006.01) |
| ***F02M 25/06*** | (2016.01) |
| ***F01M 13/02*** | (2006.01) |

(Continued)

(52) U.S. Cl.

CPC ..... *F01M 13/04* (2013.01); *F01M 13/0011* (2013.01); *F01M 13/022* (2013.01); *F02B 75/20* (2013.01); *F02M 25/06* (2013.01); *F02M 35/10222* (2013.01); *F01M 2013/0027* (2013.01); *F01M 2013/0038* (2013.01);

(Continued)

(58) Field of Classification Search

CPC .. F01M 13/04; F01M 13/0011; F01M 13/022; F02B 75/20; F02M 25/06; F02M 35/10222

See application file for complete search history.

(56) References Cited

U.S. PATENT DOCUMENTS 3,280,808 A * 10/1966 Mosher ..... F01M 13/023 123/572
3,494,339 A * 2/1970 Fernandez ..... F01M 13/025 123/573

(Continued)

FOREIGN PATENT DOCUMENTS

JP S6256705 U 4/1987
JP H0756209 B2 6/1995

(Continued)

OTHER PUBLICATIONS

Office Action dated Jun. 2, 2020 in Japanese Application No. 2017-127346.

(Continued)

*Primary Examiner* — Syed O Hasan
(74) *Attorney, Agent, or Firm* — Panitch Schwarze Belisario & Nadel LLP

(57) ABSTRACT

A blow-by gas return device includes: a gas path which is configured to introduce a blow-by gas generated in a crankcase into an intake system through an inside of a head cover, a pressure control valve and a blow-by pipe; and an orifice provided to the gas path, the orifice mounted on a wall portion of an intake manifold on a cylinder head side. A passage for a blow-by gas is formed in the wall portion on the cylinder head side, and the orifice is formed on a joint pipe mounted on the passage for the blow-by gas for communicably connecting the blow-by pipe with the passage for the blow-by gas.

16 Claims, 8 Drawing Sheets

(51) Int. Cl.
*F02B 75/20* (2006.01)
*F02B 75/18* (2006.01)

(52) U.S. Cl.
CPC ..... *F01M 2013/0455* (2013.01); *F01M 2013/0472* (2013.01); *F02B 2075/1812* (2013.01)

(56) References Cited

U.S. PATENT DOCUMENTS 4,169,432 A * 10/1979 White ..... F01M 13/025 123/41.86
2003/0230291 A1 12/2003 Ko
2004/0244785 A1* 12/2004 Nishikawa ..... F01M 13/0416 123/574
2006/0005820 A1 1/2006 Jeon
2010/0139634 A1 6/2010 Wade
2011/0073083 A1* 3/2011 Shiraishi ..... F01M 13/02 123/574
2011/0203559 A1* 8/2011 Tanikawa ..... F01M 13/0011 123/572
2012/0132158 A1 5/2012 Park
2017/0082074 A1 3/2017 Kim et al.

FOREIGN PATENT DOCUMENTS

JP 2003090206 A 3/2003
JP 2008101472 A 5/2008
JP 2014020279 A 2/2014

OTHER PUBLICATIONS

Office Action dated Nov. 20, 2020 in European Application No. 18170155.8.

* cited by examiner

BLOW-BY GAS RETURN DEVICE

CROSS-REFERENCE TO RELATED APPLICATION

This application claims priority under 35 U.S.C. § 119(b) to Japanese Patent Application No. 2017-127346, filed Jun. 29, 2017, the disclosure of which is incorporated herein by reference in its entirety.

BACKGROUND OF THE INVENTION

(1) Field of the Invention

The present invention relates to a blow-by gas return device attached to an engine.

(2) Description of Related Art

The conventional blow-by gas return device is configured such that a blow-by gas which passes through a pressure control valve mounted on a head cover is returned to an intake manifold using a blow-by pipe.

SUMMARY OF THE INVENTION

In the conventional prior art, depending on a type of an engine having a blow-by gas return device, there have been cases where the engine suffers from a following drawback. For example, in an engine where vibration or pulsation in an intake manifold is large such as a 3-cylinder engine, there is a tendency that a resonance phenomenon easily occurs. The resonance phenomenon includes a phenomenon where a pressure control valve generates an unpleasant sound such as "rattling sound" when an engine rotational speed enters a certain engine rotational speed region.

On the other hand, in cold areas or the like, there is a possibility that a blow-by pipe is chilled so that moisture contained in a blow-by gas is frozen. When the moisture is frozen so that the blow-by pipe is clogged, an internal pressure of an engine is increased so that oil seals disposed in respective portions or the like are broken or oil leaks due to such breaking of the oil seal. Accordingly, it is necessary to take some suitable countermeasure for preventing freezing of a blow-by gas.

The present invention has been made as a result of extensive studies made by inventors of the present invention, and it is an object of the present invention to provide a blow-by gas return device whose structure is rationally devised so as to prevent also freezing of a blow-by gas while preventing resonance.

According to the present invention, a blow-by gas return device includes:

a gas path which is configured to introduce a blow-by gas generated in a crankcase 1*b* into an intake system k (intake manifold 14) through an inside of a head cover 3, a pressure control valve (PCV valve) 18 and a blow-by pipe h; and an orifice 22 provided to the gas path, the orifice 22 mounted on a wall portion w of an intake manifold 14 on a cylinder head 2 side.

Further, it is convenient when the orifice 22 is provided on a joint pipe 26 formed on a mounting flange 14B as a gas relay portion 21 for a blow-by gas.

According to the present invention, the orifice is provided to the gas path and hence, it is possible to attenuate the propagation of vibration of the engine or pulsation in the intake manifold to the pressure control valve through the blow-by pipe, and it is possible to explicitly change a resonance frequency. Accordingly, the present invention has an advantageous effect that it is possible to prevent the occurrence of a drawback that an unpleasant sound is generated from the pressure control valve due to propagation of vibration or pulsation or resonance.

Further, the orifice is mounted on the wall portion of the intake manifold on the cylinder head side. Accordingly, heat of the intake manifold (the wall portion on the cylinder head side) which becomes a high temperature due to heat from a cylinder head can be transmitted to the blow-by path or the blow-by gas and hence, it is possible to realize the prevention of freezing of moisture contained in the blow-by gas or thawing of frozen moisture.

DETAILED DESCRIPTION OF PREFERRED EMBODIMENTS

Hereinafter, a preferred embodiment of the present invention relating to a blow-by gas return device is described with reference to drawings in the case where the blow-by gas return device is adopted in an industrial-use gas engine. In this industrial-use engine E, a side where a power transmission belt 9 is disposed is defined as "front", a side where a flywheel housing 16 is disposed is defined as "rear", a side where an exhaust manifold 10 is disposed is defined as "left", and a side where an intake manifold 14 is disposed is defined as "right".

Figure 6:
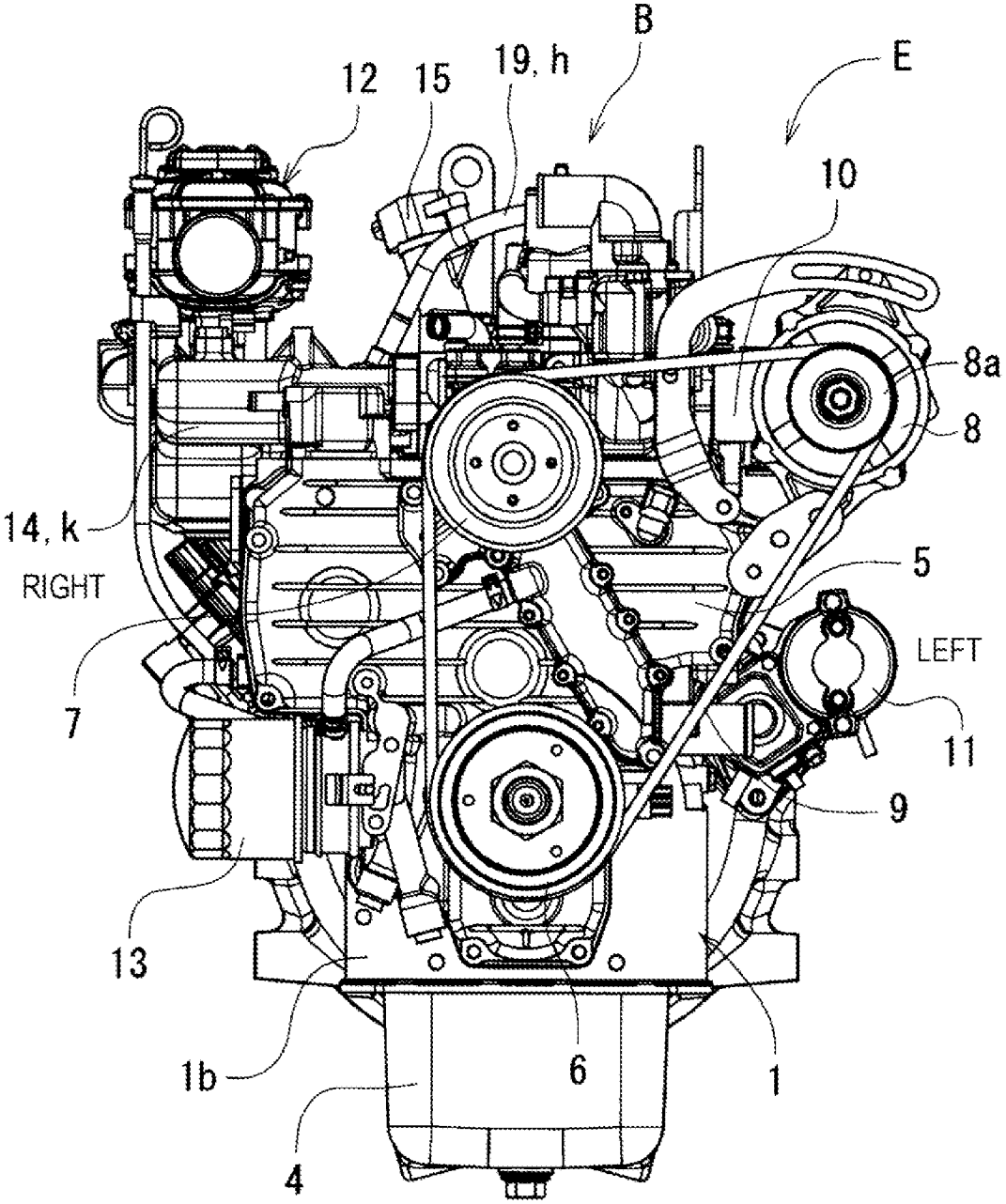
FIG. 6 is a front view of an industrial-use engine.
Figure 7:
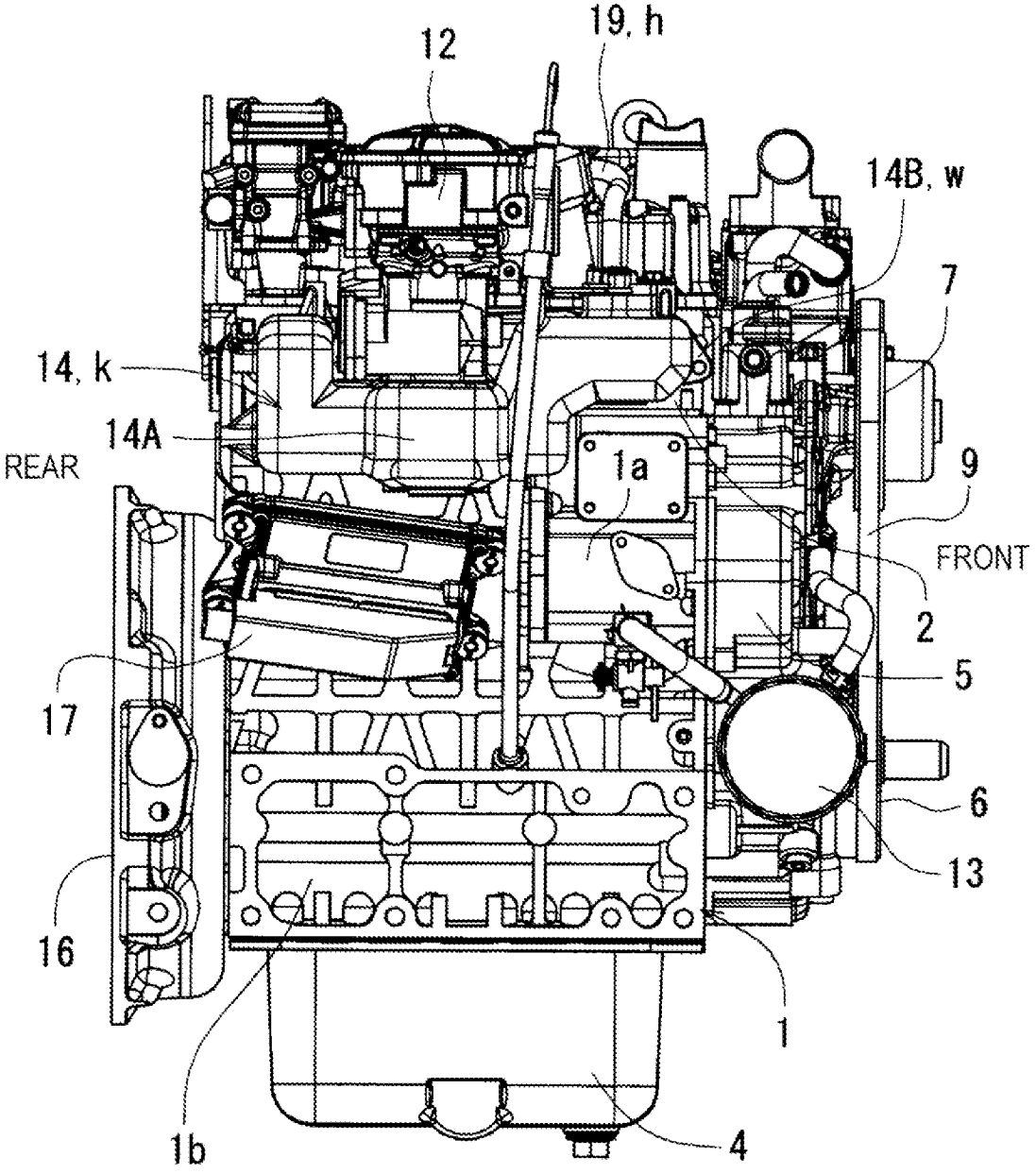
FIG. 7 is a is a right side view of the engine shown in FIG. 6.
Figure 8:
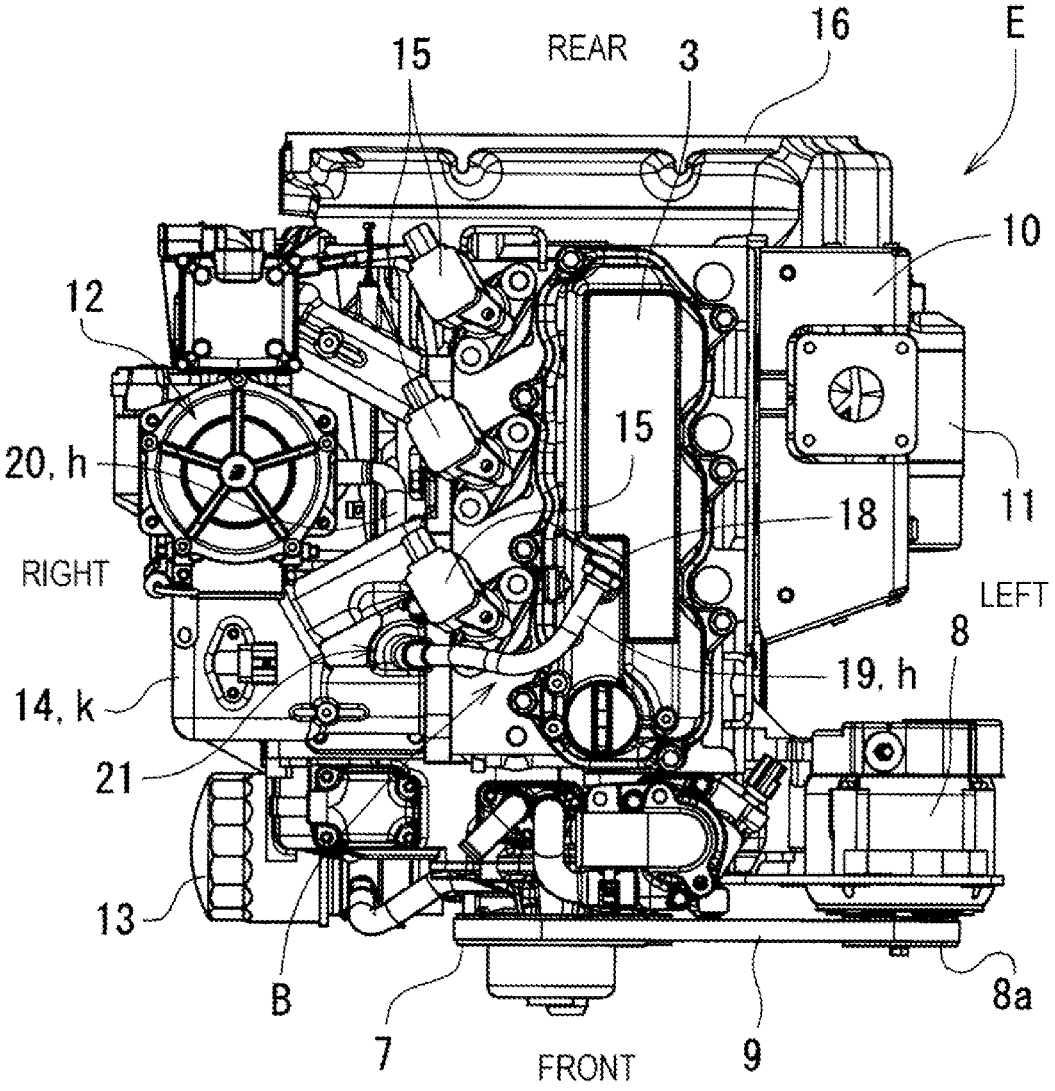
FIG. 8 is a plan view of the engine shown in FIG. 6.

As shown in FIGS. 6 to 8, in an industrial-use gas engine of in-line 3-cylinder (hereinafter, simply abbreviated as "engine") E, a cylinder head 2 is assembled to a cylinder block 1 from above, and an oil pan 4 is assembled to the cylinder block 1 from below. A lower portion of the cylinder block 1 is formed as a crankcase 1*b*, and an upper portion of the cylinder block 1 is formed as a cylinder 1*a*. A head cover (cylinder head cover) 3 is assembled to the cylinder head 2 from above. A transmission case 5 is assembled to the cylinder block 1 from a front side.

As shown in FIGS. 6 to 8, in a front portion of the engine E, a power transmission belt 9 is disposed. The power transmission belt 9 extends and is wound around a drive pulley 6, a fan pulley 7 for driving a cooling fan (not shown in the drawing), and a power receiving pulley 8*a* of a dynamo (alternator) 8. An exhaust manifold 10, a starter 11 and the like are mounted on a left side of the engine E. An oil filter 13, an intake manifold 14, a gas mixer 12, an ECU 17 and the like are mounted on a right side of the engine E. Three ignition coils 15 are disposed on an upper side of the engine E. A flywheel housing 16 is mounted on a rear portion of the engine E.

As shown in FIGS. 6 to 8, a blow-by gas return device B mounted on the engine E is configured such that a blow-by gas generated in the crankcase 1*b* is introduced into an intake system k through a blow-by pipe h by way of a PCV valve (an example of a pressure control valve) 18 mounted on the head cover 3. The blow-by pipe h includes: a first tube 19(*h*) which connects the head cover 3 (pressure control valve 18) and a gas relay portion 21 of the intake manifold 14 to each other; and a second tube 20(*h*) which connects an intake body 14A of the intake manifold 14 (an example of "intake system k") and the gas relay portion 21 to each other.

The blow-by gas return device B includes: a first heating unit t1 and a second heating unit t2 for preventing freezing of the blow-by pipe h; and an orifice 22 mounted on the gas relay portion (an example of "a passage for a blow-by gas") 21 for preventing resonance of the blow-by pipe h and the like. The first heating unit t1 uses heat of the cylinder head 2 and is mounted on the gas relay portion 21. The second heating unit t2 uses heat of cooling water, and is mounted on the intake manifold 14. Next, the blow-by gas return device B is described in detail.

As shown in FIGS. 1 to 5B, the intake manifold 14 includes; first to third branched pipe portions 14*a*, 14*b*, 14*c* at three portions for supplying air to the respective cylinders; and the box-shaped intake body 14A which communicates with these three branched pipe portions 14*a* to 14*c*. The intake manifold 14 also includes a mounting flange 14B which integrates distal end sides of the respective branched pipe portions 14*a* to 14*c* to each other. The intake manifold 14 is mounted on an engine body by threadedly mounting the mounting flange 14B on the cylinder head 2 using a plurality of bolts. A mounting seat 14*d* for mounting the gas mixer 12 is formed on an upper side of the intake body 14A at an intermediate position in a longitudinal direction.

As shown in FIGS. 1 to 3 and FIG. 5A, the first heating unit t1 includes: a cylindrical hole 24 formed in a bulging wall 23 formed in a state where the bulging wall 23 straddles between the first branched pipe portion 14*a* and the mounting flange 14B (wall portion w on a cylinder head side); and an inlet joint pipe 25 and an outlet joint pipe 26 communicating with the cylindrical hole 24. The inlet joint pipe 25 is formed of a metal pipe mounted on the bulging wall 23 in such a manner that the metal pipe projects obliquely toward an upper left side from an upper portion of the bulging wall 23. The outlet joint pipe 26 is formed of a metal sleeve mounted on the bulging wall 23 in such a manner that the metal sleeve projects toward a rear lower side from a lower portion of the bulging wall 23, and an orifice 22 is integrally formed with the outlet joint pipe 26. Numeral 27 indicates a stopper plug for closing an open side end of the cylindrical hole 24. Left side end portions of the respective branched pipe portions 14*a* to 14*c* also correspond to "wall portion w on a cylinder head side".

The outlet joint pipe 26 includes: outer peripheral male threads 26*a*; an outer peripheral flange 26*b*; an intermediate outer peripheral portion 26*c*; a removal preventing outer peripheral portion 26*d*; a large diameter flow passage 26*e* formed on a proximal end side; a hexagonal hole 26*f* formed on a distal end side; and the orifice 22 formed of a small hole and connecting the large diameter flow passage 26*e* and the hexagonal hole 26*f* with each other. The outlet joint pipe 26 is formed using a metal material. The orifice 22 is formed such that a cross-sectional area of the orifice 22 is apparently smaller than a cross-sectional area of the hexagonal hole 26*f* and a cross-sectional area of the large diameter flow passage 26*e* thus performing an orifice function. The outlet joint pipe 26 can be threadedly mounted on the bulging wall 23 (female threads: symbol being omitted) of the outlet joint pipe 26, and can be removed from the bulging wall 23 by inserting a hexagonal wrench (Allen key) into the hexagonal hole 26*f* and rotating the hexagonal wrench.

With the use of the first heating unit t1, by allowing a blow-by gas to pass through the bulging wall 23 (cylindrical hole 24), heat of the intake manifold 14 heated to high temperature with the heat transmitted from the cylinder head 2 can be transmitted to the blow-by pipe h and the like and a blow-by gas. Accordingly, it is possible to prevent freezing of moisture contained in the blow-by gas, and to thaw frozen moisture. Further, the bulging wall 23 in which the passage for the blow-by gas is formed is formed in the portion which straddles between the first branched pipe portion 14*a* and the mounting flange 14B, both of those being the wall portion on a cylinder head side, and hence, it is possible to acquire an advantageous effect that heat from the cylinder head 2 can be more effectively transmitted to the blow-by pipe h and the like.

Since the orifice 22 is formed in the gas relay portion 21, it is possible to attenuate the transmission of vibration of the engine and pulsation in the intake manifold to the PCV valve 18 by way of the blow-by pipe h (19), and it is also possible to largely change a resonance frequency. Accordingly, the present invention has an advantageous effect that it is possible to acquire an advantageous effect that the occurrence of a drawback that an unpleasant sound is generated from the PCV valve 18 or the like due to propagation of vibration or pulsation or resonance is prevented. Further, both the orifice 22 and the first heating unit t1 are formed in the gas relay portion 21 and hence, the configurations of these two parts 22, t1 can be used in common. Accordingly, it is possible to provide the rational structure which also leads to the reduction of a manufacturing cost.

Further, the intake system k into which a blow-by gas is introduced is disposed in the intake body 14A which is a portion disposed on a side opposite to a cylinder head side in the intake manifold 14. Accordingly, it is possible to acquire an advantageous effect that a blow-by gas can be distributed to the branched pipe portions 14*a* to 14*c* mounted on respective cylinders in a well-balanced manner. For example, in a unit where an intake manifold has the structure where branched pipe portions are not provided or are extremely short or a blow-by gas is returned to a mounting flange 14B portion, there is a possibility of occurrence of a drawback that a blow-by gas is supplied to any one of cylinders in a non-uniform manner. However, with the configuration of the present invention, such a drawback can be eliminated or suppressed.

That is, the orifice 22 mounted in a gas path through which a blow-by gas flows is mounted on the wall portion w of the intake manifold 14 on a cylinder head side. The passage 21 for a blow-by gas is formed in the wall portion w on the cylinder head side. The orifice 22 is formed in the joint pipe 26 which is mounted in the passage 21 for a blow-by gas for connecting the blow-by pipe h with the passage 21 for a blow-by gas communicably. Further, a portion p into which a blow-by gas is introduced is disposed in the box-shaped intake body 14A which is a portion of the intake manifold 14 and is disposed on a side opposite to a cylinder head side and communicates with all branched pipe portions 14*a* to 14*c*.

All of the first tube 19, the inlet joint pipe 25, the bulging wall 23, the outlet joint pipe 26, the second tube 20, a return pipe 29 (described later) and the like are gas paths (symbols being omitted).

As shown in FIGS. 1 to 4 and FIG. 5B, a return flow portion 28 for a blow-by gas is formed in a lower portion of a longitudinally center portion of the intake body 14A at a position close to a cylinder head side (left side). The return pipe 29 formed of a metal pipe and into which the second tube 20 (blow-by pipe h) is fitted is mounted on the return flow portion 28 which is a wall portion forming the intake manifold 14 and having a large wall thickness such that the return pipe 29 projects from the return flow portion 28. The configuration is adopted where a blow-by gas supplied from the gas relay portion 21 through the second tube 20 is returned via the return flow portion 28 to the intake body 14A.

A flow passage 30 which is a passage for cooling water is formed in the return flow portion 28. The flow passage 30 is formed as a space portion which is surrounded by a lid member (riser) 31 detachably mounted on a bottom wall portion 28A of the return flow portion 28 and the bottom wall portion 28A. An inlet 32 and an outlet 33 for cooling water communicated with the flow passage 30 are formed in the return flow portion 28. The inlet 32 for cooling water is formed in the form of a bent pipe 32 which is mounted on a bottom wall 31A of the lid member 31 in a downwardly projecting manner, and the outlet 33 for cooling water is formed in the form of a straight pipe 33 which is mounted on a peripheral wall 31B of the lid member 31 in a projecting manner.

Figure 1:
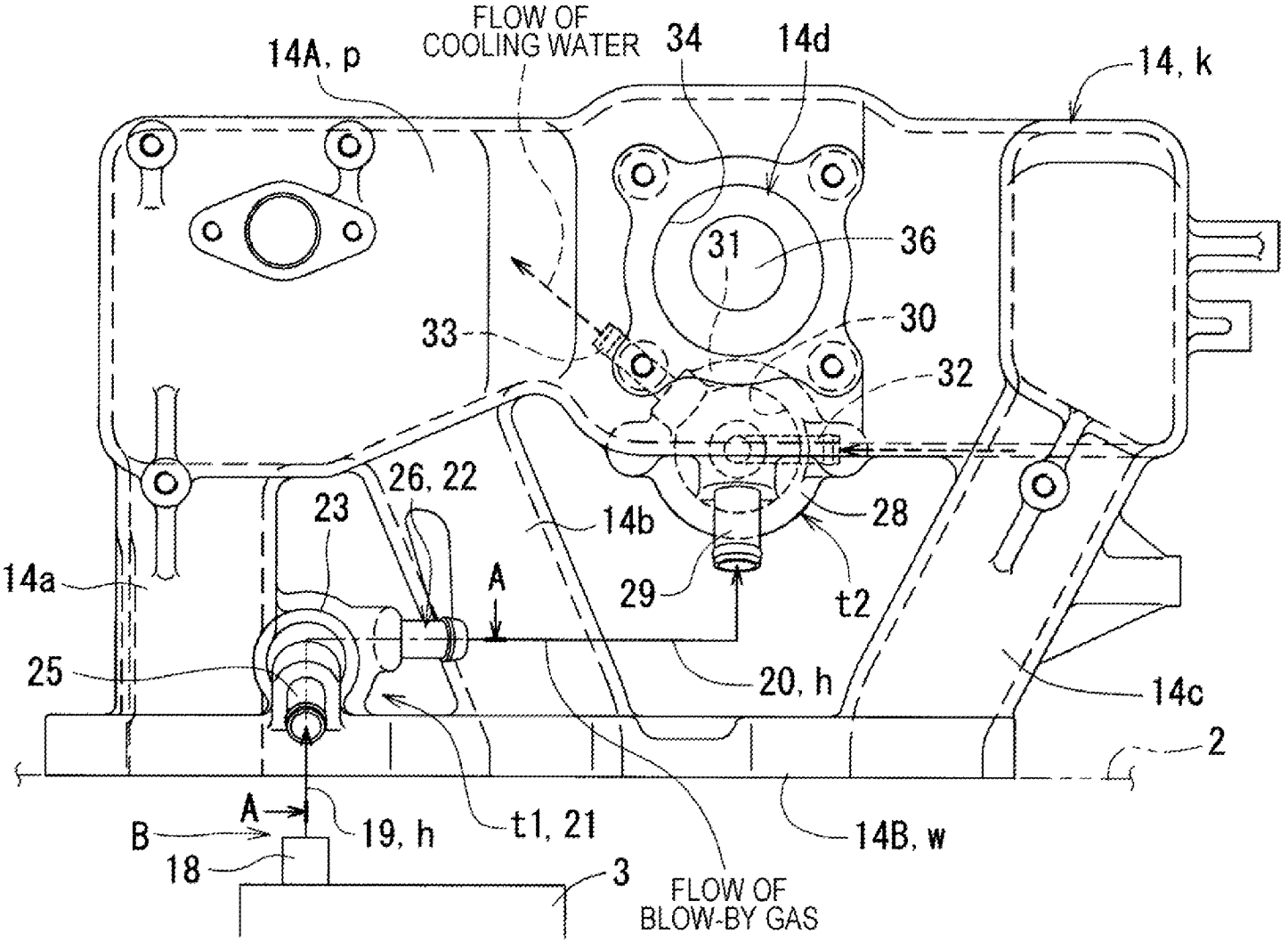
FIG. 1 is a schematic view of a blow-by gas return structure and a plan view showing an intake manifold.
Figure 2:
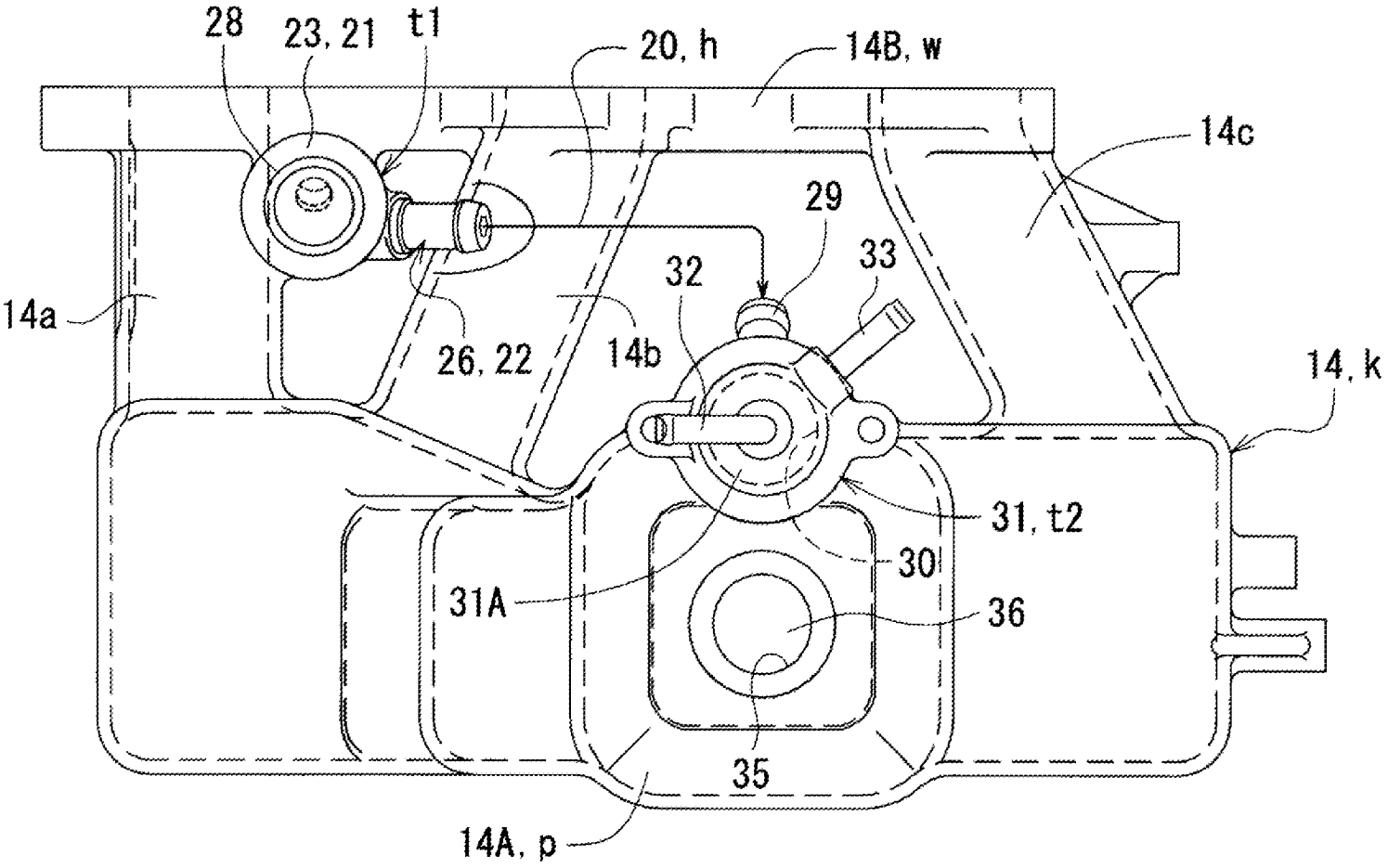
FIG. 2 is a bottom view of the intake manifold.
Figure 3:
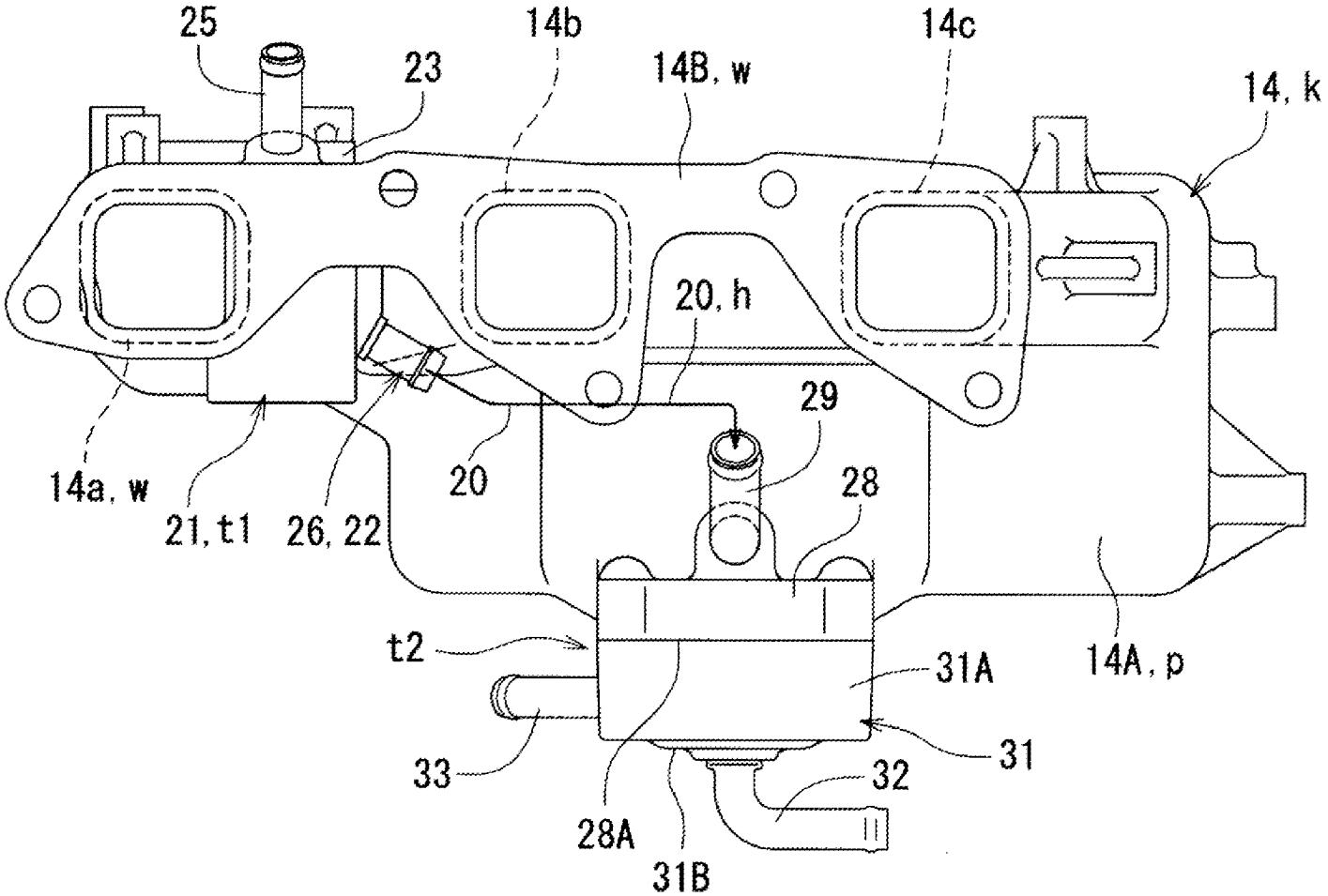
FIG. 3 is a left side view of the intake manifold.
Figure 4:
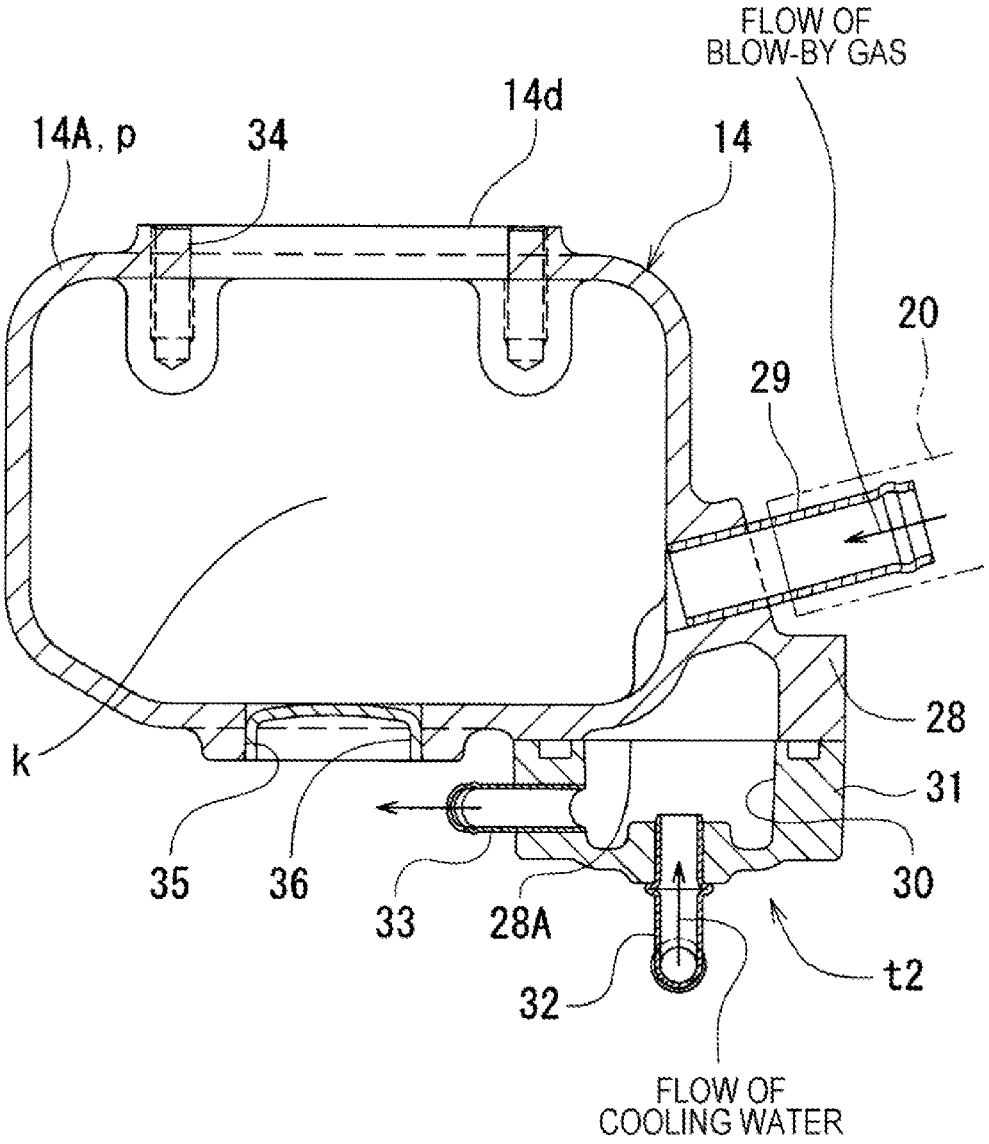
FIG. 4 is a cross-sectional view taken along line A-A in FIG. 1.
Figure 5A:
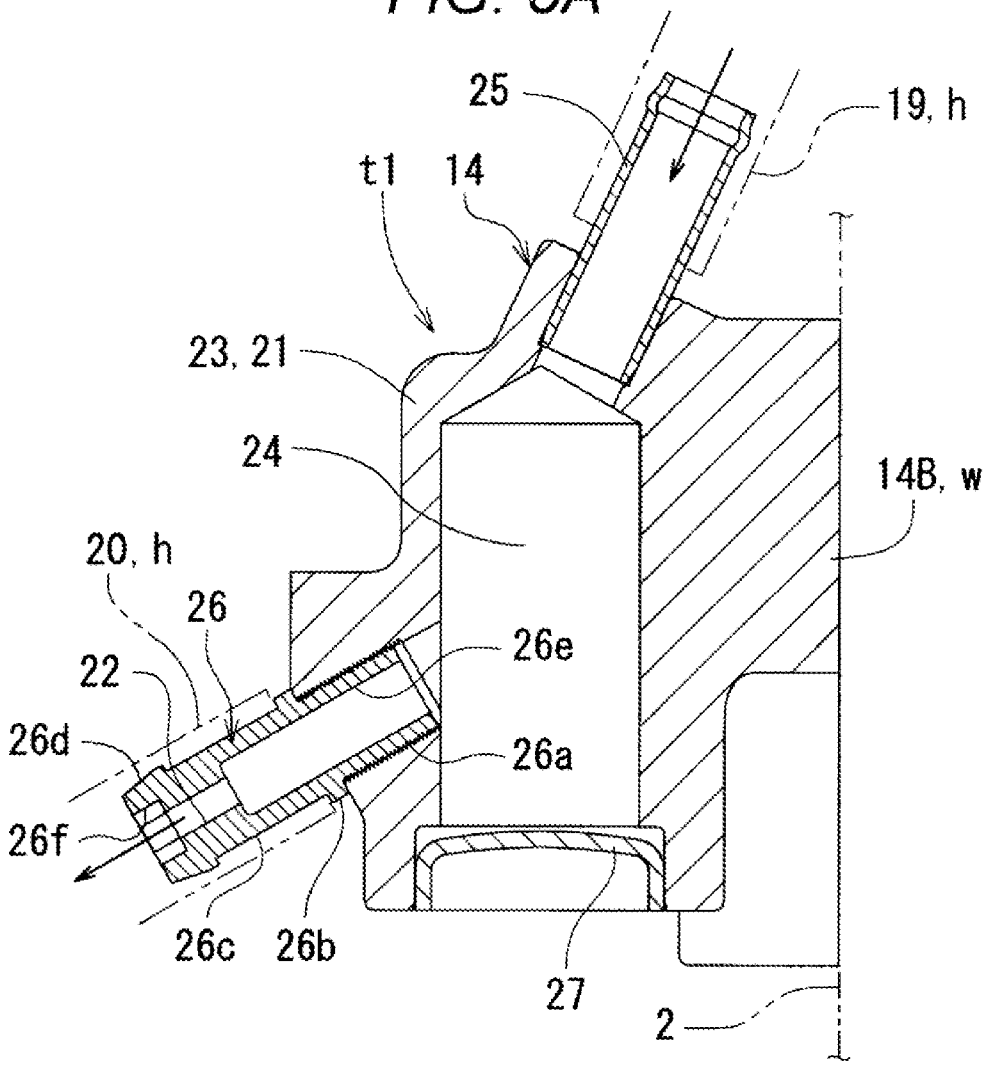
FIG. 5A is a cross-sectional view of a main part showing an orifice for a blow-by gas.
Figure 5B:
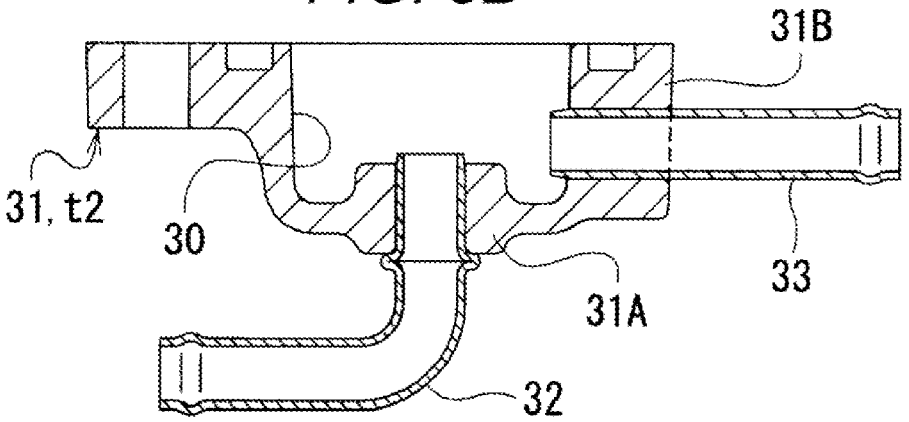
FIG. 5B is a cross-sectional view showing a lid member (riser) through which cooling water passes.

Cooling water enters the flat cylindrical flow passage 30 from the bent pipe 32 and is discharged from the straight pipe 33. Cooling water which flows through the flow passage 30 warms the return flow portion 28 from the bottom wall portion 28A, and also warms a blow-by gas which passes through the return flow portion 28. Accordingly, the second heating unit t2 is formed of the return flow portion 28, the lid member 31 and the like. In FIG. 4, symbol 34 indicates a large circular hole formed in the mounting seat 14*d*, and numeral 36 indicates a closing plug which closes a temporary hole 35 formed in a lower end portion of the intake body 14A.

The second heating unit t2 which uses cooling water as a heat source is formed on the return flow portion 28 which is a return portion from which a brow-by gas returns to the intake system k through the blow-by pipe h. Accordingly, the return flow portion 28 and a blow-by gas which flows in the return flow portion 28 are warmed by heat of cooling water so that freezing of the blow-by pipe h (a terminal portion of the second tube 20) and a blow-by path is prevented or freezing is thawed whereby it is possible to expect an effect of eliminating closing by freezing. The second heating unit t2 is disposed on a lower side of the return flow portion 28. This structure is preferable from a viewpoint of conduction of heat.

The lid member 31 which is a part for forming the second heating unit t2 is detachably mounted on the bottom wall portion 28A by two bolts, and the inlet 32 and the outlet 33 for cooling water are formed in the lid member 31 which forms a side detachably mounted on the bottom wall portion 28A. Accordingly, when the blow-by gas return device adopts the specification where the second heating unit t2 is unnecessary, the lid member 31 may not be assembled or may be removed. Further, in the case where the lid member 31 is removed, the bent pipe 32 and the straight pipe 33 are also removed. Accordingly, it is possible to adopt a rational unit where there are almost no wasteful parts (lid member 31 and the like) in the specification where the second heating unit t2 is unnecessary.

Another Example

A pressure control valve 18 may be a valve other than a PCV valve such as a breather valve. The intake system k may be mounted on a portion other than the intake manifold 14 such as an air cleaner or an intake duct.

The present invention is applicable to a blow-by gas return device attached to various engines such as a diesel engine and a gasoline engine having cylinders other than 3-cylinders, that is, 2-cylinders or 5-cylinders.

What is claimed is:

1. A blow-by gas return device comprising:

a gas path which is configured to introduce a blow-by gas generated in a crankcase into an intake system through an inside of a head cover, a pressure control valve and a blow-by pipe;

a passage for the blow-by gas being formed on a mounting flange of an intake manifold, the mounting flange being mounted on a cylinder head, and an orifice being formed in the passage for the blow-by gas, the intake manifold including:

a plurality of branched pipe portions;

an intake body communicating with the plurality of branched pipe portions respectively; and the mounting flange integrating distal end sides of the respective branched pipe portions to each other, the distal end sides being located in a downstream location of an air supply direction, the intake system is disposed in the intake body, wherein the blow-by pipe is configured to introduce the blow-by gas having flowed through the passage for the blow-by gas to the intake body, and wherein the blow-by pipe includes: a first tube which connects the pressure control valve mounted on the head cover and the passage for the blow-by gas; and a second tube which connects the passage for the blow-by gas and the intake body.

2. The blow-by gas return device according to claim 1, wherein the orifice is formed on a joint pipe mounted on the passage for the blow-by gas for communicably connecting the blow-by pipe with the passage for the blow-by gas.

3. The blow-by gas return device according to claim 1, wherein the passage for the blow-by gas is provided in a bulging wall formed on the mounting flange.

4. The blow-by gas return device according to claim 2, wherein the passage for the blow-by gas is provided in a bulging wall formed on the mounting flange.

5. The blow-by gas return device according to claim 1, wherein the intake system to which the blow-by gas is introduced forms the intake manifold, and the intake system is mounted on a portion of the intake manifold on a side opposite to the cylinder head side.

6. The blow-by gas return device according to claim 2, wherein the intake system to which the blow-by gas is introduced forms the intake manifold, and the intake system is mounted on a portion of the intake manifold on a side opposite to the cylinder head side.

7. The blow-by gas return device according to claim 3, wherein the intake system to which the blow-by gas is introduced forms the intake manifold, and the intake system is mounted on a portion of the intake manifold on a side opposite to the cylinder head side.

8. The blow-by gas return device according to claim 4, wherein the intake system to which the blow-by gas is introduced forms the intake manifold, and the intake system is mounted on a portion of the intake manifold on a side opposite to the cylinder head side.

9. The blow-by gas return device according to claim 1, wherein the blow-by gas return device is used for an in-line 3-cylinder engine.

10. The blow-by gas return device according to claim 2, wherein the blow-by gas return device is used for an in-line 3-cylinder engine.

11. The blow-by gas return device according to claim 3, wherein the blow-by gas return device is used for an in-line 3-cylinder engine.

12. The blow-by gas return device according to claim 4, wherein the blow-by gas return device is used for an in-line 3-cylinder engine.

13. The blow-by gas return device according to claim 5, wherein the blow-by gas return device is used for an in-line 3-cylinder engine.

14. The blow-by gas return device according to claim 6, wherein the blow-by gas return device is used for an in-line 3-cylinder engine.

15. The blow-by gas return device according to claim 7, wherein the blow-by gas return device is used for an in-line 3-cylinder engine.

16. The blow-by gas return device according to claim 8, wherein the blow-by gas return device is used for an in-line 3-cylinder engine.

* * * * *